US011230095B2

(12) United States Patent
Tsukada

(10) Patent No.: US 11,230,095 B2
(45) Date of Patent: Jan. 25, 2022

(54) METHOD OF CONTROLLING LIQUID EJECTION APPARATUS AND LIQUID EJECTION APPARATUS

(71) Applicant: SEIKO EPSON CORPORATION, Tokyo (JP)

(72) Inventor: Kenji Tsukada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 60 days.

(21) Appl. No.: 16/588,039

(22) Filed: Sep. 30, 2019

(65) Prior Publication Data

US 2020/0108596 A1 Apr. 9, 2020

(30) Foreign Application Priority Data

Oct. 4, 2018 (JP) ..... JP2018-189100

(51) Int. Cl.
*B41J 2/045* (2006.01)
*B41J 2/165* (2006.01)

(52) U.S. Cl.
CPC ..... *B41J 2/0451* (2013.01); *B41J 2/04581* (2013.01); *B41J 2/16505* (2013.01); *B41J 2/16532* (2013.01); *B41J 2002/16573* (2013.01)

(58) Field of Classification Search
CPC .. B41J 2/0451; B41J 2/16532; B41J 2/04581; B41J 2/16505; B41J 2002/16573
See application file for complete search history.

(56) References Cited

U.S. PATENT DOCUMENTS

2005/0243122 A1* 11/2005 Usuda ..... B41J 2/16579 347/29
2011/0181652 A1* 7/2011 Komatsu ..... B41J 2/125 347/19

FOREIGN PATENT DOCUMENTS

JP 2010-058416 3/2010
JP 2017-094578 6/2017

* cited by examiner

*Primary Examiner* — Justin Seo
(74) *Attorney, Agent, or Firm* — Workman Nydegger

(57) ABSTRACT

A method of controlling a liquid ejecting apparatus includes detecting an ejection failure of nozzles by inspecting an ejection state of the nozzles from which liquid is ejected, covering the nozzles with a cap when the number of the nozzles whose ejection failure is detected is equal to or less than a predetermined number, and discharging the liquid from the nozzles when the number of the nozzles whose ejection failure is detected is greater than the predetermined number.

11 Claims, 7 Drawing Sheets

METHOD OF CONTROLLING LIQUID EJECTION APPARATUS AND LIQUID EJECTION APPARATUS

The present application is based on, and claims priority from JP Application Serial Number 2018-189100, filed Oct. 4, 2018, the disclosure of which is hereby incorporated by reference herein in its entirety.

BACKGROUND

1. Technical Field

The present disclosure relates to a method of controlling a liquid ejecting apparatus and a liquid ejecting apparatus.

2. Related Art

JP-A-2017-94578 describes a liquid ejecting apparatus including an ejection head having nozzles from which liquid is ejected. The liquid ejecting apparatus ejects the liquid from the nozzles in order to solve the ejection failure when the ejection failure of the nozzles occurs.

In such a liquid ejecting apparatus, when the liquid is discharged from the nozzles each time an ejection failure occurs in the nozzles, the consumption of the liquid is likely to increase.

SUMMARY

A method of controlling liquid ejecting apparatus according to an aspect of the present disclosure includes detecting, by inspecting an ejection state of nozzles from which liquid is ejected, an ejection failure of the nozzles, covering the nozzles with a cap when the number of the nozzles whose ejection failure is detected is equal to or less than a predetermined number, and discharging the liquid from the nozzles when the number of the nozzles whose ejection failure is detected is greater than the predetermined number.

A liquid ejecting apparatus according to another aspect of the present disclosure includes a liquid ejecting head that ejects liquid from a plurality of nozzles, a cap configured to cover the nozzles, a detecting portion that detects an ejection failure of the nozzles by inspecting an ejection state of the nozzles, a maintenance unit that discharges the liquid from the nozzles, and a controller. The controller covers the nozzles with the cap when the number of the nozzles whose ejection failure is detected by the detecting portion is equal to or less than a predetermined number, and discharges the liquid from the nozzles by the maintenance unit when the number of the nozzles whose ejection failure is detected by the detecting portion is greater than the predetermined number.

DESCRIPTION OF EXEMPLARY EMBODIMENTS

Hereinafter, an embodiment of a liquid ejecting apparatus will be described with reference to the drawings. The liquid ejecting apparatus is, for example, an ink jet printer that prints an image such as characters and photographs by ejecting ink, which is an example of liquid, onto a medium such as paper.

Figure 1:
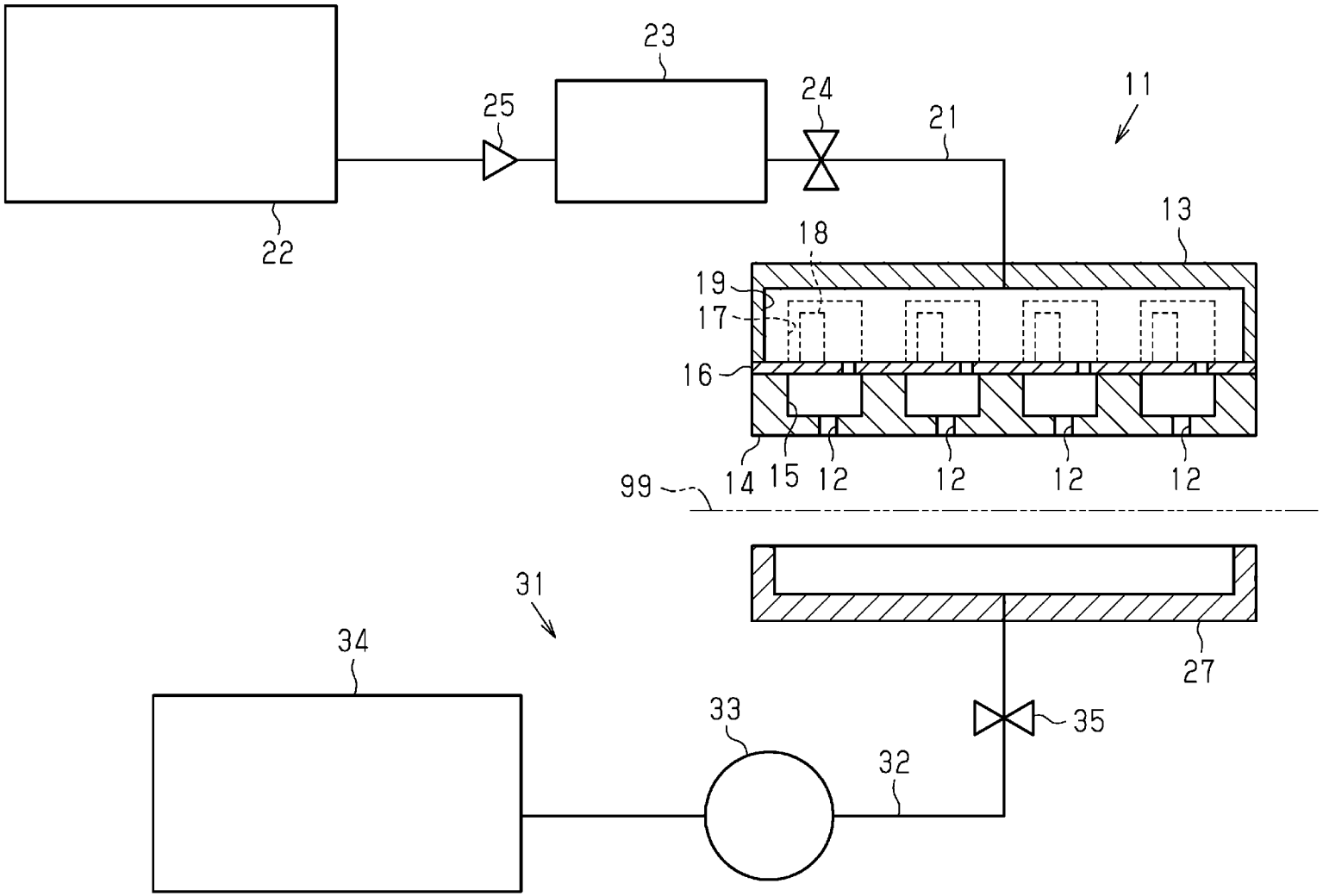
FIG. 1 is an entire configuration diagram showing an embodiment of a liquid ejecting apparatus.

As shown in FIG. 1, a liquid ejecting apparatus 11 includes a liquid ejecting head 13 that ejects liquid from a plurality of nozzles 12. The liquid ejecting head 13 has a nozzle formation face 14 in which the plurality of nozzles 12 is formed. The liquid ejecting head 13 performs printing on a medium 99 by ejecting the liquid toward the medium 99. The liquid ejecting head 13 according to the present embodiment ejects four color inks of cyan, magenta, yellow and black.

The liquid ejecting head 13 includes an individual liquid chamber 15 communicating with each nozzle 12, an accommodation chamber 17 partitioned from the individual liquid chamber 15 by a diaphragm 16, and an actuator 18 accommodated in the accommodation chamber 17. The liquid ejecting head 13 includes a common liquid chamber 19 communicating with a plurality of individual liquid chambers 15. The common liquid chamber 19 temporarily stores the supplied liquid. The liquid stored in the common liquid chamber 19 is supplied to the individual liquid chambers 15.

The actuator 18 is, for example, a piezoelectric element that contracts when a drive voltage is applied. After the diaphragm 16 is deformed with the contraction of the actuator 18, when the application of the drive voltage is released, the liquid in the individual liquid chambers 15 whose volume has changed is ejected from the respective nozzles 12.

The liquid ejecting apparatus 11 may include a supply flow channel 21 through which the liquid supplied to the liquid ejecting head 13 flows. For example, the liquid may be supplied from a liquid container 22 containing the liquid to the liquid ejecting head 13 through the supply flow channel 21. The supply flow channel 21 couples the liquid container 22 and the liquid ejecting head 13. The supply flow channel 21 is composed of, for example, a tube or the like.

The liquid container 22 is capable of containing a liquid. The liquid container 22 may be a cartridge that can be attached to and detached from the liquid ejecting apparatus 11, or may be a tank that can be replenished with the liquid. The liquid container 22 may be directly coupled to the liquid ejecting head 13.

The liquid ejecting apparatus 11 may include a pressurizing portion 23 that pressurizes the liquid in the supply flow channel 21. The pressurizing portion 23 is located midway of the supply flow channel 21. The pressurizing portion 23 is, for example, a diaphragm pump. The liquid is supplied from the liquid container 22 to the liquid ejecting head 13 through the supply flow channel 21 by driving the pressurizing portion 23. The pressurizing portion 23 may be a tube pump, or may have a configuration in which the flexible portion provided in the supply flow channel 21 is deformed by mechanical pressure or air pressure to pressurize the liquid in the supply flow channel 21. The pressurizing portion 23 may not be located midway of the supply flow channel 21 but may be a pressurizing pump provided so as to pressurize the inside of the liquid container 22 with air. The liquid ejecting apparatus 11 may be configured to supply the liquid using a water head difference between the liquid container 22 and the liquid ejecting head 13.

The liquid ejecting apparatus 11 may include a first valve 24 which is an on-off valve capable of opening/closing the supply flow channel 21. The first valve 24 is located between the pressurizing portion 23 and the liquid ejecting head 13 in the supply flow channel 21. When the first valve 24 opens, the supply flow channel 21 opens. When the first valve 24 is closed, the supply flow channel 21 is closed. When the pressurizing portion 23 is driven with the first valve 24 closed, the pressurizing force of the pressurizing portion 23 is accumulated in the supply flow channel 21.

The liquid ejecting apparatus 11 may include a one-way valve 25. The one-way valve 25 is provided, for example, in the supply flow channel 21. The one-way valve 25 of the present embodiment is located between the liquid container 22 and the pressurizing portion 23 in the supply flow channel 21. The one-way valve 25 allows the liquid to flow downstream and stops the liquid from flowing upstream in the flow direction of the liquid. Instead of the one-way valve 25, an on-off valve capable of opening/closing the supply flow channel 21 may be disposed.

The liquid ejecting apparatus 11 includes a cap 27 configured to cover the nozzles 12. The cap 27 covers the nozzles 12, for example, by contacting the nozzle formation face 14 of the liquid ejecting head 13. In this way, covering the nozzles 12 with the cap 27 is referred to as capping. When the capping is performed, a space which the nozzles 12 face is formed in the cap 27.

When the capping is performed, the cap 27 may come close to the liquid ejecting head 13 or the liquid ejecting head 13 may come close to the cap 27. When the capping is performed, both the cap 27 and the liquid ejecting head 13 may come close to each other. The capping makes it possible to moisturize the nozzles 12.

The liquid ejecting apparatus 11 may eject the liquid from the nozzles 12 into the cap 27 when the capping is performed. At this time, the liquid may be ejected from the nozzles 12 into the cap 27 after the cap 27 covers the nozzles 12, or the liquid may be ejected from the nozzles 12 into the cap 27 before the cap 27 covers the nozzles 12. In this case, the capping is performed with the liquid adhering to the inside of the cap 27. When the capping is performed with the liquid adhering to the inside of the cap 27, the space in the cap 27 is moistened by the liquid. This further moisturizes the nozzles 12. In this way, performing the capping with the liquid adhering to the inside of the cap 27 is referred to as a moisturizing capping.

The liquid ejecting apparatus 11 includes a maintenance unit 31 that discharges the liquid from the nozzles 12. For the liquid ejecting head 13, the liquid may be thickened or air bubbles may be mixed in the nozzles 12, the individual liquid chambers 15, and in the common liquid chamber 19. In this case, it may not be possible to eject the liquid normally from the nozzles 12. That is, an ejection failure of the nozzles 12 may occur. When the ejection failure of the nozzles 12 occurs, the failure leads to the nozzle clogging of the liquid ejecting head 13. The nozzle clogging means a state of an ejection failure of the nozzles 12 in the liquid ejecting head 13.

The maintenance unit 31 maintains the liquid ejecting head 13. The maintenance unit 31 performs cleaning as maintenance of the liquid ejecting head 13. Discharging the liquid from the nozzles 12 is referred to as cleaning. When the cleaning is performed, the thickened liquid, air bubbles, and the like in the liquid ejecting head 13 are discharged from the nozzles 12. As a result, the ejection failure of the nozzles 12 can be solved.

The maintenance unit 31 of the present embodiment includes a suction flow channel 32 and a suctioning portion 33. The suction flow channel 32 is coupled to the cap 27. The suctioning portion 33 is provided in the suction flow channel 32. The suctioning portion 33 sucks the liquid inside of the cap 27 through the suction flow channel 32. The suctioning portion 33 is, for example, a tube pump. The suctioning portion 33 may be a diaphragm pump.

When the suctioning portion 33 is driven in the capping state, the inside of the cap 27 has a negative pressure. When the inside of the cap 27 has a negative pressure, the liquid is forcibly discharged from the nozzles 12. In this way, discharging the liquid from the nozzles 12 by the negative pressure generated by the drive of the suctioning portion 33 is referred to as suction cleaning. When the suction cleaning is performed, the liquid is discharged from the nozzles 12 into the cap 27.

The liquid ejecting apparatus 11 may include a waste liquid container 34 that stores the liquid discharged from the nozzles 12 as a waste liquid. The waste liquid container 34 is coupled to the suction flow channel 32. The suctioning portion 33 of the present embodiment is located between the cap 27 and the waste liquid container 34 in the suction flow channel 32. When the suctioning portion 33 is driven with the inside of the cap 27 open to the atmosphere, the liquid is discharged from the inside of the cap 27 through the suction flow channel 32. In the present embodiment, the liquid is discharged from the inside of the cap 27 by driving the suctioning portion 33 in a non-capping state. In this way, discharging the liquid from the inside of the cap 27 is referred to as an idle suction. When the idle suction is performed, the liquid in the cap 27 is stored in the waste liquid container 34 through the suction flow channel 32.

The cap 27 may have an air release channel that opens the inside of the cap 27 to the atmosphere, and an air release valve that opens and closes the air release channel. In this case, even in the capping state, the inside of the cap 27 can communicate with the air by opening the air release valve. That is, the idle suction can be performed in the capping state. When performing the suction cleaning, the air release valve is closed.

The liquid ejecting apparatus 11 may include a second valve 35 which is an on-off valve capable of opening/closing the suction flow channel 32. When the second valve 35 is closed, the suction flow channel 32 is closed. When the second valve 35 is opened, the suction flow channel 32 is opened.

The maintenance unit 31 may perform suction cleaning with the first valve 24 closed. In this case, the inside of the liquid ejecting head 13 and the inside of the supply flow channel 21 has a negative pressure by the drive of the suctioning portion 33. As a result, the air bubbles contained in the liquid in the liquid ejecting head 13 and in the supply flow channel 21 expand. When the first valve 24 is opened while the suctioning portion 33 is driven, the expanded air bubbles together with the liquid are vigorously discharged from the nozzles 12. In this way, suctioning with the first valve 24 closed and thereafter discharging the liquid from the nozzles 12 by opening the first valve 24 is referred to as chalk cleaning.

The maintenance unit 31 may include the supply flow channel 21 and the pressurizing portion 23. When the pressurizing portion 23 pressurizes the liquid in the liquid ejecting head 13, the liquid is forcibly discharged from the nozzles 12. In this way, discharging the liquid from the nozzles 12 by the pressurization by the pressurizing portion 23 is referred to as pressure cleaning. The maintenance unit 31 may perform pressure cleaning using the pressurizing force accumulated in the supply flow channel 21 by closing the first valve 24.

The liquid ejecting apparatus 11 may perform flushing in addition to maintenance by the maintenance unit 31. The flushing means that the liquid ejecting head 13 ejects a liquid unrelated to printing from the nozzles 12. When the flushing is performed, thickening of the liquid in the nozzles 12 is suppressed. The moisturizing capping may be performed using a liquid ejected by the flushing. In this case, the cap 27 receives the liquid ejected by the flushing. A member other than the cap 27 may receive the liquid ejected by the flushing. For example, the liquid may be ejected toward the waste liquid container 34 or may be ejected toward a flushing receiver which is separately provided. Generally, the amount of liquid ejected by flushing is smaller than the amount of liquid discharged by cleaning, but the amount of liquid ejected by flushing may be greater than the amount of liquid discharged by cleaning.

Figure 2:
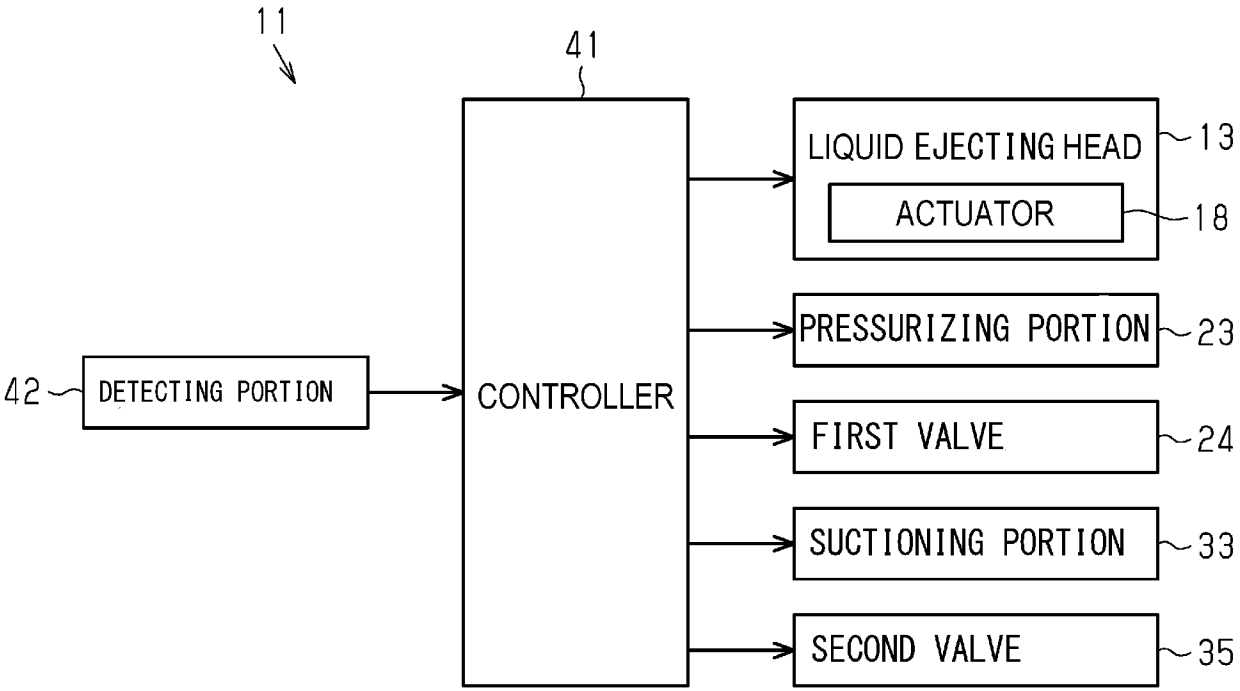
FIG. 2 is a block diagram showing an electrical configuration of a liquid ejecting apparatus.

As shown in FIG. 2, the liquid ejecting apparatus 11 includes a controller 41. The controller 41 collectively controls the liquid ejecting apparatus 11. The controller 41 includes a CPU and a memory. The liquid ejecting apparatus 11 is controlled by the CPU executing a program stored in the memory. The controller 41 of the present embodiment controls the liquid ejecting head 13, the pressurizing portion 23, the first valve 24, the suctioning portion 33, and the second valve 35.

The liquid ejecting apparatus 11 includes a detecting portion 42 that detects an ejection failure of the nozzles 12. The detecting portion 42 of the present embodiment is composed of a detection circuit that detects a residual vibration of the diaphragm 16 that constitutes the individual liquid chambers 15. When a voltage is applied to the actuator 18, the diaphragm 16 is bent and deformed. This causes pressure fluctuations in the individual liquid chambers 15. Due to the fluctuations, the diaphragm 16 vibrates for a while. This vibration is referred to as a residual vibration. The detecting portion 42 detects the vibration of the diaphragm 16 via the actuator 18. In this way, detecting the state of the individual liquid chambers 15 and the state of the nozzles 12 leading to the respective individual liquid chambers 15 from the residual vibration is referred to as a nozzle inspection. The nozzle inspection allows the ejection state of the nozzles 12 to be inspected. The nozzle inspection can be performed even when the vibration does not accompany the ejection of the liquid.

For example, when the liquid in the individual liquid chambers 15 is thickened, the period of the residual vibration tends to be long. For example, when air bubbles are mixed in the individual liquid chambers 15, the period of the residual vibration tends to be short. In this way, the detecting portion 42 can detect the ejection failure of the nozzles 12 based on the residual vibration.

The method of the nozzle inspection according to which the ejection state of the nozzles 12 is inspected in the liquid ejecting apparatus 11 includes the following methods other than the method of detecting and analyzing the vibration pattern of the residual vibration of the diaphragm 16 as described above. For example, there is a method in which when light is emitted to the meniscus in the nozzles 12 from the light emitting element, and the light receiving element receives the reflected light, the vibration state of the meniscus is detected, and the ejection state of the nozzles 12 based on the detected vibration state is inspected. There is a method of inspecting the ejection state of the nozzles 12 using a general optical detecting portion that detects whether the liquid ejected from the nozzles 12 has entered the detection range of the sensor. There is a method of inspecting the ejection state of the nozzles 12 using a heat detection type detecting portion that detects a change in temperature of the heat detection element that receives the ejected liquid. There is a method of inspecting the ejection state of the nozzles 12 using a detecting portion that detects a change in the charge amount of the detection electrode to which the liquid has been landed after the charged liquid from the nozzles 12 is ejected. There is a method of inspecting the ejection state of the nozzles 12 using a capacitance type detecting portion which changes as the ejected liquid passes between the electrodes. There is a method of inspecting the ejection state of the nozzles 12 by detecting an inspection pattern formed by ejecting the liquid from the nozzles 12 to the medium 99 or the like as image information by a detecting portion such as a camera.

In the liquid ejecting apparatus 11, when an ejection failure of the nozzles 12 is detected, it is necessary to solve the ejection failure. However, when the cleaning is performed to solve the ejection failure each time an ejection failure occurs in the nozzles 12, the consumption of liquid increases.

As a method of controlling the liquid ejecting apparatus 11 capable of reducing the consumption of liquid includes detecting an ejection failure of the nozzles 12 by inspecting an ejection state of the nozzles 12 which eject the liquid, covering the nozzles 12 with the cap 27 when the number of the nozzles 12 nozzles whose ejection failure is detected is equal to or less than a predetermined number, and discharging the liquid from the nozzles 12 when the number of the nozzles 12 nozzles whose ejection failure is detected is greater than the predetermined number. For example, the controller 41 covers the nozzles 12 with the cap 27 when the number of the nozzles 12 nozzles whose ejection failure is detected by the detecting portion 42 is equal to or less than a predetermined number, and ejects the liquid from the nozzles 12 by the maintenance unit 31 when the number of the nozzles 12 nozzles whose ejection failure is detected by the detecting portion 42 is greater than the predetermined number.

When the nozzles 12 are moistened by capping, the ejection failure of the nozzles 12 may be solved. In particular, when the cause of the ejection failure of the nozzles 12 is thickening of the liquid, the thickening of the liquid may be solved by moisturizing the nozzles 12. When the cause of the ejection failure of the nozzles 12 is the mixture of air bubbles, it is possible to eliminate the air bubbles with the passage of time while suppressing the thickening of the liquid by capping. In this way, it is expected to solve the ejection failure of the nozzles 12 by capping. For this reason, when the number of the nozzles 12 nozzles whose ejection failure is detected by inspecting the ejection state of the nozzles 12 is equal to or less than a predetermined number, that is, when the nozzle clogging is minor, there is a high possibility that the ejection failure of the nozzles 12 is solved by capping.

When the number of the nozzles 12 nozzles whose ejection failure is detected by inspecting the ejection state of the nozzles 12 is greater than a predetermined number, that is, when the nozzle clogging is serious, there is a low possibility that the ejection failure of the nozzles 12 is solved even when the nozzles 12 is moistened by capping. Therefore, when the number of the nozzles 12 nozzles whose ejection failure is detected is greater than the predetermined number, the liquid is discharged from the nozzles 12. As a result, the ejection failure of the nozzles 12 can be solved.

As described above, when the number of the nozzles 12 nozzles whose ejection failure is detected is equal to or less than the predetermined number, the ejection failure may be solved by capping without discharging the liquid from the nozzles 12. Therefore, it is possible to reduce the frequency of discharging the liquid from the nozzles 12 in order to solve the ejection failure of the nozzles 12. Therefore, the consumption of the liquid can be reduced.

The predetermined number is a value stored in advance in the memory of the controller 41. The predetermined number is a value that is expected to have a large influence on the printing quality when the number of the nozzles 12 in which the ejection failure has occurred exceeds the predetermined number. The predetermined number is a value of one or more. The predetermined number may be set so that the value can be changed.

A method of controlling the liquid ejecting apparatus 11 may include, when the number of the nozzles 12 nozzles whose ejection failure is detected is equal to or less than a predetermined number, ejecting the liquid from the nozzles 12 into the cap 27, and covering the nozzles 12 by the cap 27. For example, when the number of the nozzles 12 nozzles whose ejection failure is detected by the detecting portion 42 is equal to or less than a predetermined number, the controller 41 may eject the liquid from the nozzles 12 into the cap 27, and cover the nozzles 12 by the cap 27. When the nozzles 12 are covered by the cap 27 into which the liquid is ejected, the nozzles 12 are further moisturized. As a result, the possibility of solving the ejection failure of the nozzles 12 can be improved.

A method of controlling the liquid ejecting apparatus 11 may include repeating the inspection of the ejection state of the nozzles 12, and when the number of the nozzles 12 nozzles whose ejection failure is detected is equal to or less than a predetermined number and continuously increases, discharging the liquid from the nozzles 12. For example, the controller 41 may repeat the inspection of the ejection state of the nozzles 12, and discharge the liquid from the nozzles 12 by the maintenance unit 31 when the number of the nozzles 12 nozzles whose ejection failure is detected by the detecting portion 42 is equal to or less than a predetermined number and continuously increases. In a case where the number of the nozzles 12 nozzles whose ejection failure is detected is on the rise even when the number is equal to or less than a predetermined number, it can be assumed that the ejection failure is not solved just by covering the nozzles 12 with the cap 27. Therefore, when the number of the nozzles 12 nozzles whose ejection failure is detected increases continuously, the liquid is discharged from the nozzles 12. As a result, the ejection failure of the nozzles 12 can be solved.

A method of controlling the liquid ejecting apparatus 11 may include inspecting the ejection state of the nozzles 12 after the print is completed. In this case, an appropriate operation can be performed to solve the ejection failure of the nozzles 12 after the print is completed.

A method of controlling the liquid ejecting apparatus 11 may include inspecting the ejection state of the nozzles 12 before the print is started. By inspecting the ejection state of the nozzles 12 before the print is started, it is possible to reduce the possibility of performing printing by the nozzles 12 in which the ejection failure has occurred. As a result, it is possible to suppress deterioration of the printing quality.

The liquid ejecting apparatus 11 may perform complementary printing in which the liquid to be ejected from the nozzles 12 in which the ejection failure has occurred is compensated by the liquid ejected from the normal nozzles 12. For example, consider the case where an ejection failure occurs in one of the plurality of nozzles 12 that ejects the same type of liquid. In this case, the lack of dots is complemented by ejecting a liquid from the normal nozzles 12 located in the vicinity of the nozzles 12 in which the ejection failure has occurred. At this time, the liquid ejected from the normal nozzles 12 are set to be larger in size after landing than the liquid to be ejected from the nozzles in which the ejection failure has occurred. For example, when an abnormality occurs in the nozzles 12 from which black ink is ejected, the lack of dots of the black is complemented by applying the liquids of yellow, cyan and magenta in a superposed manner at a position to which the liquid to be ejected from the nozzles 12 is landed.

Next, an example of the maintenance process performed by the liquid ejecting apparatus 11 will be described. The maintenance process is a process for eliminating the nozzle clogging. First, a first maintenance process, which is an example of the maintenance process, will be described. The first maintenance process is performed, for example, after printing on the medium 99 is completed.

Figure 3:
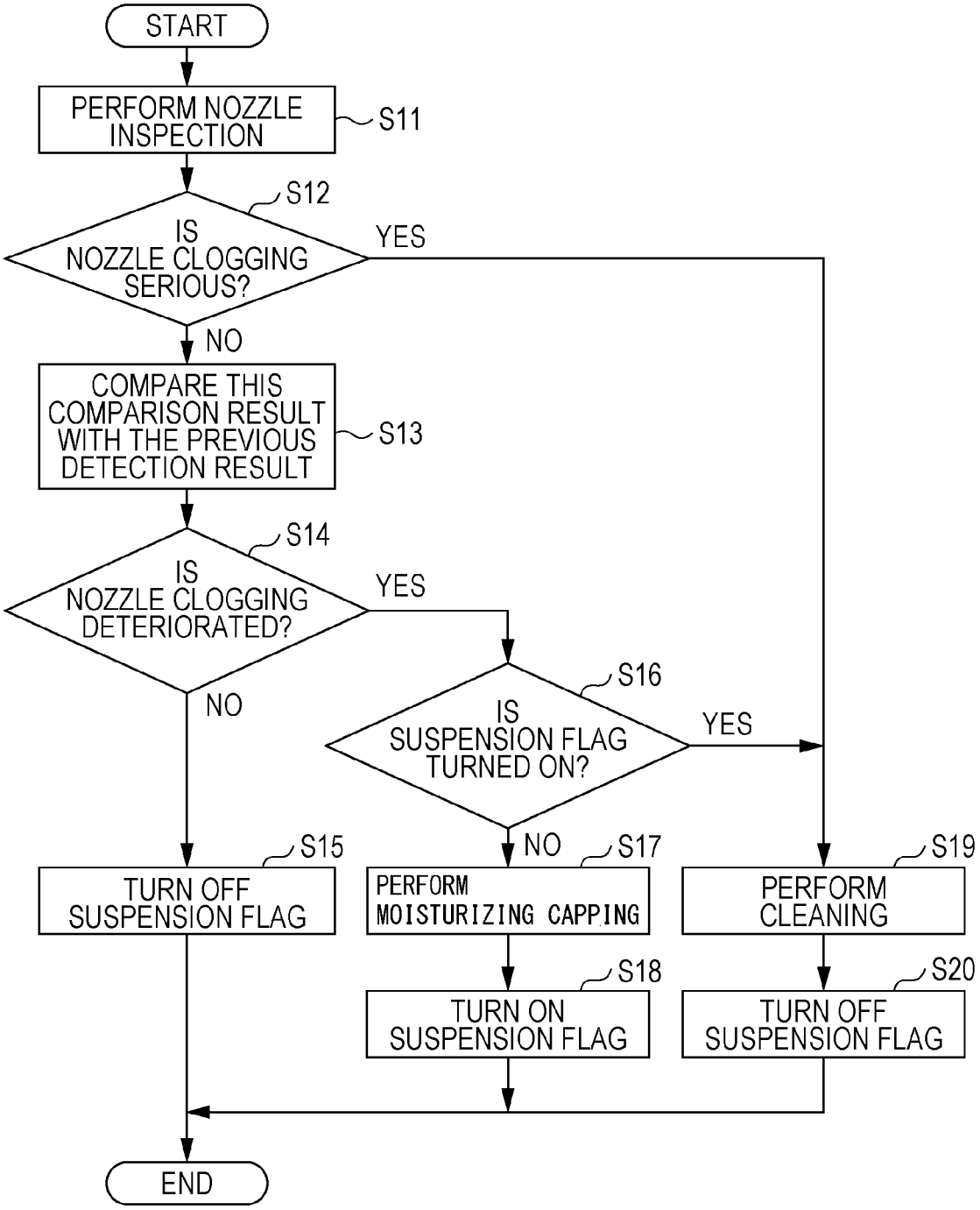
FIG. 3 is a flowchart of a first maintenance process.

As shown in FIG. 3, the controller 41 that performs the first maintenance process first performs a nozzle inspection in step S11. At this time, the controller 41 detects an ejection failure of the nozzles 12 based on the result of the nozzle inspection. The controller 41 stores the detection result of the ejection failure of the nozzles 12.

In step S12, the controller 41 determines whether the nozzle clogging is serious. At this time, the controller 41 determines whether the nozzle clogging is serious based on the detection result of the ejection failure of the nozzles 12 by the nozzle inspection performed in step S11. The controller 41 shifts the process to step S19 when the nozzle clogging is serious, or shifts the process to step S13 when the nozzle clogging is minor or there is no nozzle clogging.

For example, in step S12, the controller 41 determines whether the number of the nozzles 12 nozzles whose ejection failure is detected is greater than a predetermined number. At this time, the controller 41 compares the number of the nozzles 12 nozzles whose ejection failure is detected in step S11 with a predetermined number. When the number of the nozzles 12 nozzles whose ejection failure is detected is greater than the predetermined number, the controller 41 determines that the nozzle clogging is serious to shift the process to step S19. When the number of the nozzles 12 nozzles whose ejection failure is detected is equal to or less than the predetermined number, the controller 41 determines that the nozzle clogging is minor to shift the process to step S13.

The liquid ejecting head 13 according to the present embodiment has six nozzle rows, each of which is composed of 241 nozzles 12, per color. Therefore, the liquid ejecting head 13 has 1446 nozzles 12 per color. The controller 41 according to the present embodiment determines that the nozzle clogging is serious when an ejection failure occurs in 145 or more nozzles 12 out of the 1446 nozzles 12 per color. That is, the predetermined number in the present embodiment is 144, which corresponds to 10% of the 1446 nozzles 12.

For example, in step S12, the controller 41 may determine whether the nozzle clogging is serious based on the number in which the nozzles 12 nozzles whose ejection failure is detected are continuously arranged. The controller 41 may determine that the nozzle clogging is serious when 24 or more nozzles 12 nozzles whose ejection failure is detected are continuously arranged in one row of nozzles where the 241 nozzles 12 are arranged. In the case where 24 or more nozzles 12 in which the ejection failure has occurred in one nozzle row are continuously arranged, that is, 10% or more of the number of the nozzles 12 in one nozzle row are continuously arranged even when the number of the nozzles 12 in which the ejection failure has occurred in the six nozzle rows is 144 or less, the impact on printing quality is expected to increase.

In step S13, the controller 41 compares the present detection result with the previous detection result with respect to the ejection failure of the nozzles 12. When the previous detection result is not recorded, the controller 41 skips the process of step S13.

In step S14, the controller 41 determines whether the nozzle clogging is deteriorated. At this time, the controller 41 determines whether the nozzle clogging is deteriorated based on the comparison result in step S13. The controller 41 shifts the process to step S16 when the nozzle clogging is deteriorated, and shifts the process to step S15 when the nozzle clogging is not deteriorated. When the controller 41 skips the process of step S13, the controller 41 also skips the process of step S14 and shifts the process to step S15.

For example, in step S14, the controller 41 determines whether the number of the nozzles 12 in which the ejection failure has occurred has increased. At this time, the controller 41 determines whether the number of the nozzles 12 in which the ejection failure has occurred has increased from that of the previous time based on the comparison result in step S13. When the number of the nozzles 12 in which the ejection failure has occurred increases, the controller 41 determines that the nozzle clogging is deteriorated to shift the process to step S16. When the number of the nozzles 12 in which the ejection failure has occurred does not increase, the controller 41 determines that the nozzle clogging is not deteriorated to shift the process to step S15.

In step S14, the controller 41 may determine whether complementary printing is possible, in addition to whether the nozzle clogging is deteriorated. When complementary printing is possible even when the nozzle clogging is deteriorated, it is possible to suppress deterioration of the printing quality by complementing the nozzles 12 in which the ejection failure has occurred with the normal nozzles 12, so that the process may proceed to step S15. The case where complementary printing can not be performed is, for example, a case where two or more nozzles 12 in which the ejection failure has occurred are continuously arranged in one nozzle row.

In step S15, the controller 41 is turned off a suspension flag. The suspension flag is information indicating that the cleaning is suspended. That is, when the suspension flag is turned on, it can be grasped that the cleaning is suspended. The suspension flag is stored in the memory of the controller 41. After completing the process of step S15, the controller 41 ends the first maintenance process.

When the nozzle clogging is deteriorated in step S14, the controller 41 determines whether the suspension flag is turned on in step S16. When the suspension flag is turned on, the controller 41 shifts the process to step S19. When the suspension flag is turned off, the controller 41 shifts the process to step S17.

The controller 41 performs the moisturizing capping in step S17. In step S17, since the nozzle clogging is deteriorated while being minor, the moisturizing capping is performed to solve the ejection failure of the nozzles 12. In step S17, the controller 41 may perform the normal capping instead of the moisturizing capping.

In step S18, the controller 41 determines that the cleaning is suspended to turn on the suspension flag. Usually, when the nozzle clogging occurs, the cleaning is performed to solve the ejection failure of the nozzles 12. In this respect, in the present embodiment, when the nozzle clogging is minor, the moisturizing capping is performed to solve the ejection failure of the nozzles 12. That is, the cleaning is suspended by performing the moisturizing capping instead of cleaning. The controller 41 ends the maintenance process when the process of step S18 is completed.

When the nozzle clogging is serious in step S12, or, when the suspension flag is turned on in step S16, in step S19, the controller 41 performs the cleaning. In the present embodiment, the suction cleaning is performed in step S19. In the case where the nozzle clogging is serious, the possibility that the ejection failure of the nozzles 12 is solved is low even when the moisturizing capping is performed. Therefore, the cleaning is performed.

When the suspension flag is turned on, it is recognized that the cleaning has been suspended in the previous maintenance process. In this case, although the moisturizing capping has been performed in order to solve the ejection failure of the nozzles 12 in the previous maintenance process, the nozzle clogging is deteriorated. From this, even when the moisturizing capping is performed again, the possibility that the ejection failure of the nozzles 12 is solved is low. Therefore, when the deterioration of the nozzle clogging continuously occurs in the nozzle inspection which is repeatedly performed, the cleaning is performed. As a result, the ejection failure of the nozzles 12 is solved.

In step S16, step S17 and step S19, the controller 41 suspends the cleaning and performs the moisturizing capping when the deterioration of the nozzle clogging occurs for first time. In step S16, step S17 and step S19, controller 41 performs the cleaning when the deterioration of the nozzle clogging continues twice, that is, when the number of the nozzles 12 nozzles whose ejection failure is detected is on the rise.

In step S20, the controller 41 turns off the suspension flag. After the process of step S20 is completed, the controller 41 ends the maintenance process. Next, a second maintenance process will be described as an example of the maintenance process. The second maintenance process is performed, for example, after printing on the medium 99 is completed. The second maintenance process is a maintenance process in which the processing of step S15 is replaced with the processing of step S31, the processing of step S16 is replaced with the processing of step S32, the processing of step S18 is replaced with the processing of step S33, and the processing of step S20 is replaced with the processing of step S34, as compared with the first maintenance process. Therefore, the second maintenance process will be mainly described for points different from those for the first maintenance process.

Figure 4:
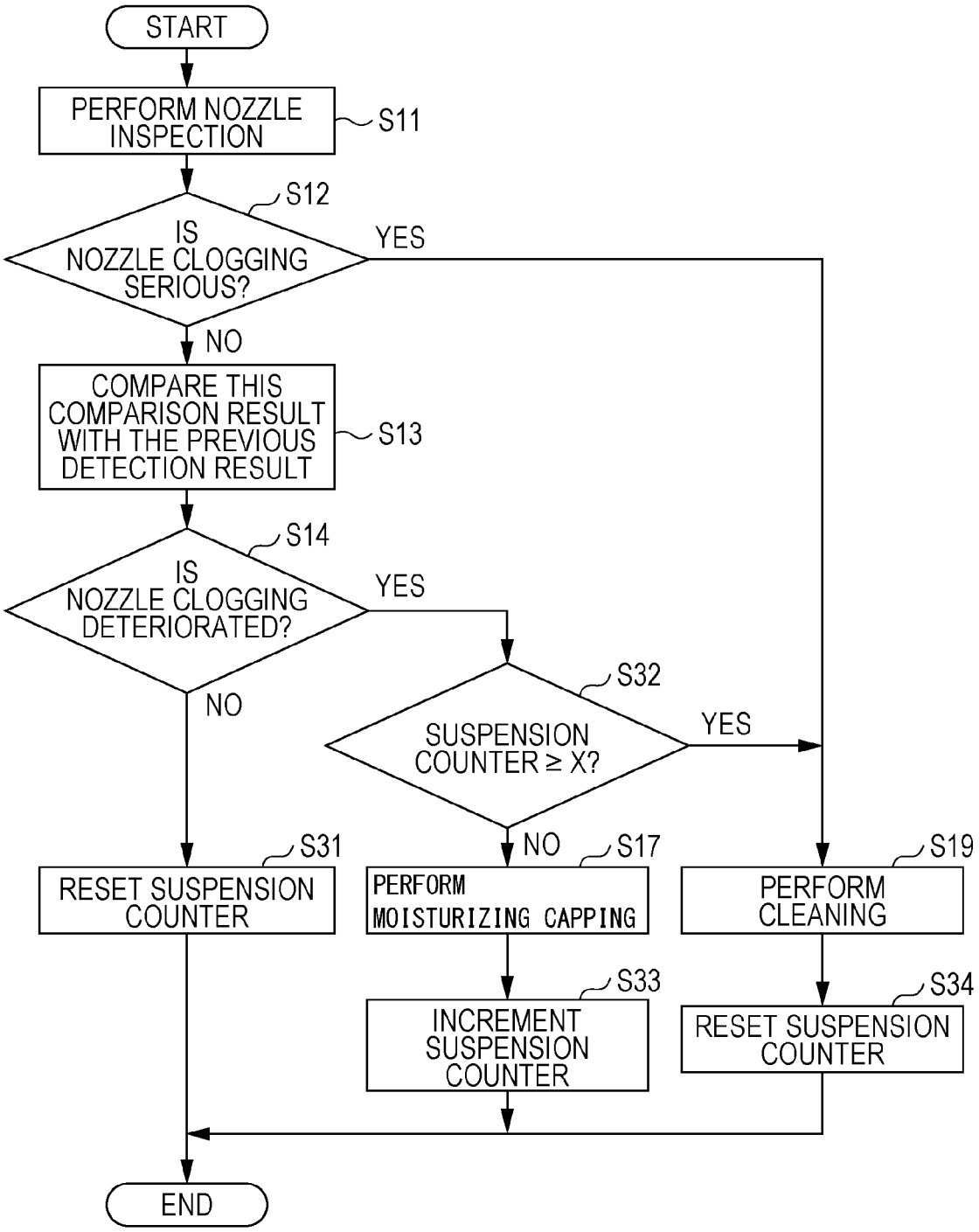
FIG. 4 is a flowchart of a second maintenance process.

As shown in FIG. 4, when the controller 41 that performs the second maintenance process determines in step S14 that the nozzle clogging is not deteriorated, in step S31, the controller 41 resets the suspension counter. The suspension counter is a counter that indicates the number of times the cleaning is suspended. For example, when the value of the suspension counter is 2, it indicates that the cleaning has been suspended twice. When the suspension counter is reset, the suspension counter value becomes 0. After completing the process of step S31, the controller 41 ends the second maintenance process.

When it is determined in step S14 that the nozzle clogging is deteriorated in step S14, the controller 41 determines whether the value of the suspension counter is equal to or more than the set number X in step S32. The set number X is any number to be set. The controller 41 shifts the process to step S19 when the value of the suspension counter is equal to or greater than the set number X. When the value of the suspension counter is smaller than the set number X, the controller 41 shifts the process to step S17.

After performing the moisturizing capping in step S17, the controller 41 increments the suspension counter in step S33. That is, in step S33, the controller 41 increments the value of the suspension counter by one. The controller 41 determines that the cleaning is suspended by performing the moisturizing capping to increment the suspension counter. After completing the process of step S33, the controller 41 ends the second maintenance process.

When the value of the suspension counter is equal to or greater than the set number X in step S32, that is, when the number of times the cleaning is suspended is equal to or more than the set number X, the controller 41 performs the cleaning in step S19.

After performing the cleaning in step S19, the controller 41 resets the suspension counter in step S34. After completing the process of step S34, the controller 41 ends the second maintenance process.

According to the second maintenance process, the cleaning can be suspended any number of times. While the number of times the cleaning is suspended is up to one in the first maintenance process, the number of times the cleaning is suspended can be set to any number in the second maintenance process. The frequency of the cleaning can be reduced by increasing the number of times the cleaning is suspended.

Next, a third maintenance process, which is an example of the maintenance process, will be described. The third maintenance process is performed, for example, after printing on the medium 99 is completed. The third maintenance process is a maintenance process in which the process of step S41 is added between the process of step S14 and the process of step S16, as compared with the first maintenance process. Therefore, the third maintenance process will be mainly described for points different from those for the first maintenance process.

Figure 5:
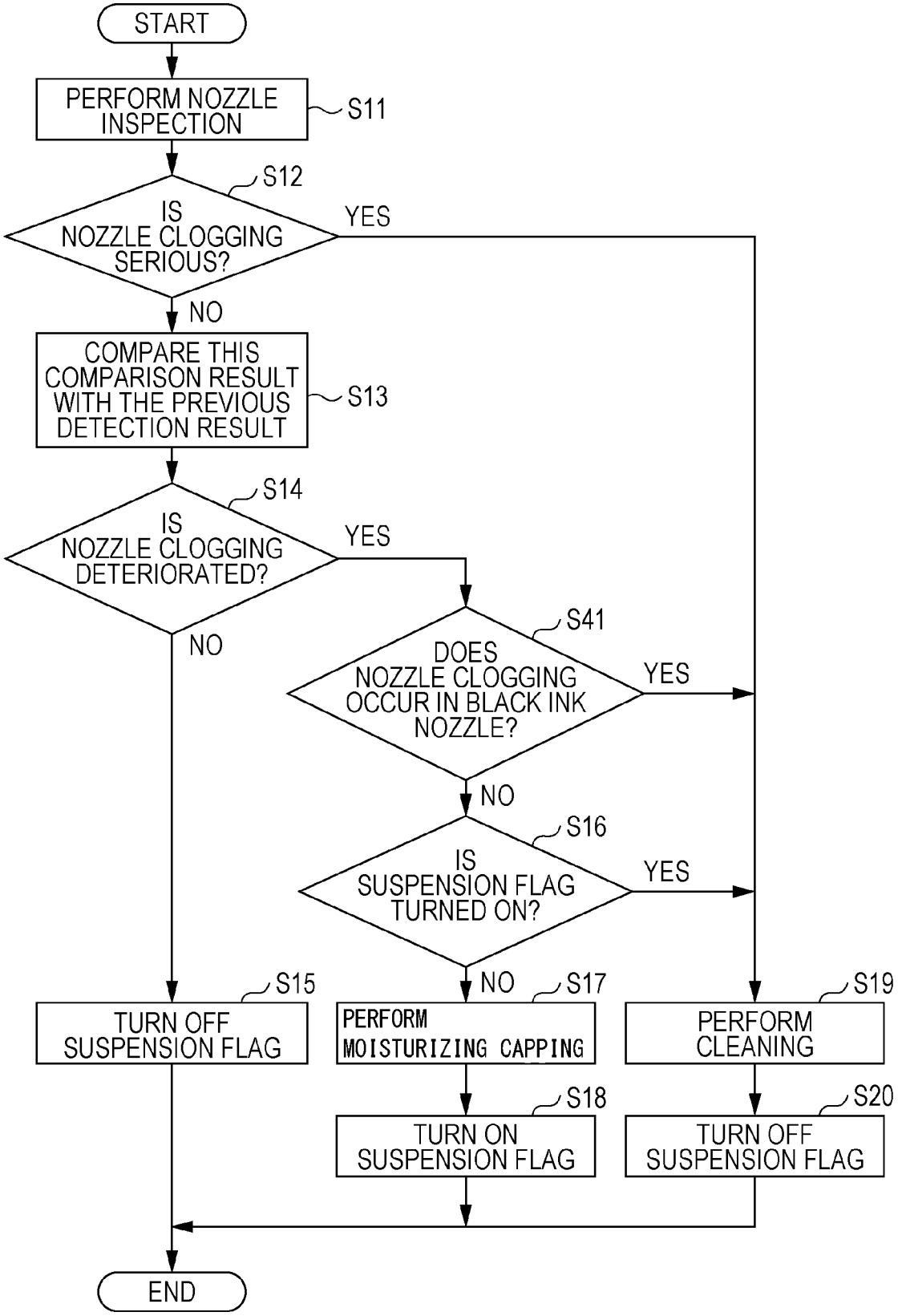
FIG. 5 is a flowchart of a third maintenance process.

As shown in FIG. 5, when the controller 41 that performs the third maintenance process determines in step S14 that the nozzle clogging is deteriorated, the controller 41 determines in step S41 that whether a nozzle clogging occurs in the nozzles 12 from which the black ink is ejected. The controller 41 shifts the process to step S19 when a nozzle clogging occurs in the nozzles 12 from which the black ink is ejected, or shifts the process to step S16 when no nozzle clogging occurs in the nozzles 12 that eject the black ink.

The black ink is used in color printing and monochrome printing. Therefore, the frequency of use of the black ink is generally high. In particular, for users who frequently perform monochrome printing, the frequency of use of the black ink is further high. When a nozzle clogging occurs in the nozzles 12 from which the black ink is ejected, the nozzle clogging is likely to affect the printing quality because the frequency of use of the black is high. In this respect, in the third maintenance process, the cleaning is performed when a nozzle clogging occurs in the nozzles 12 from which the black ink is ejected. In this way, according to the third maintenance process, it is possible to suppress deterioration of the printing quality. In addition, for users who frequently perform monochrome printing, it is desirable to less consume the color ink. In this respect, in the third maintenance process, even when the nozzle clogging is deteriorated, the cleaning is suspended when no nozzle clogging occurs in the nozzles 12 from which the black ink is ejected, and the suspension flag is turned off. In this way, according to the third maintenance process, it is possible to suppress an increase in the consumption of the color ink.

Next, a fourth maintenance process, which is an example of the maintenance process, will be described. The fourth maintenance process is performed, for example, before starting printing on the medium 99. In this case, the fourth maintenance process is performed when print data is input. The fourth maintenance process is a maintenance process in which the process of step S16, the process of step S17, and the process of step S18 are omitted, as compared with the first maintenance process. Therefore, the fourth maintenance process will be mainly described for points different from those for the first maintenance process.

Figure 6:
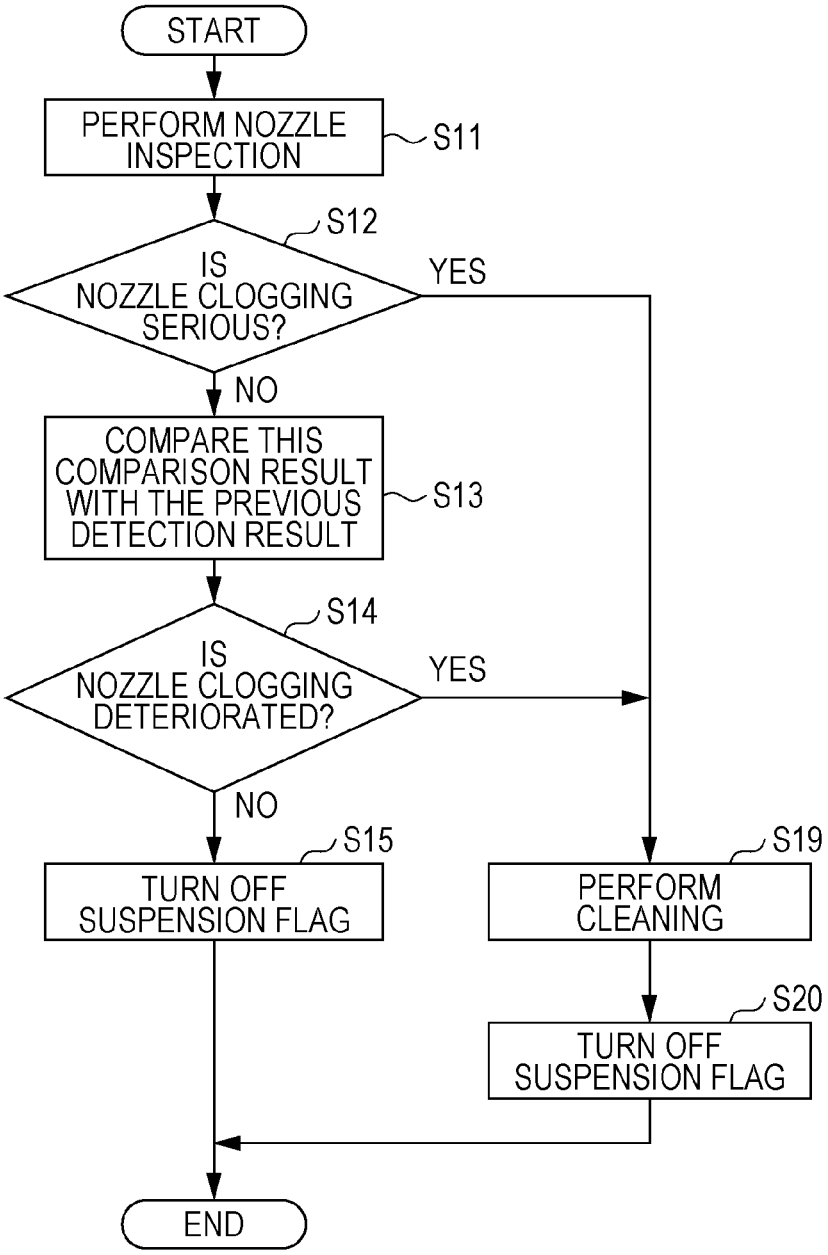
FIG. 6 is a flowchart of a fourth maintenance process.

As shown in FIG. 6, when the controller 41 that performs the fourth maintenance process determines in step S14 that the nozzle clogging is deteriorated, the controller 41 shifts the process to step S19. The controller 41 performs the cleaning in step S19. Unlike the first maintenance process, the fourth maintenance process is performed before printing. Therefore, even when the moisturizing capping is performed, it is difficult to secure time for solving the ejection failure of the nozzles 12. When the moisturizing capping is performed until the ejection failure of the nozzles 12 is solved, it takes time to start printing. In the fourth maintenance process, when it is determined that the nozzle clogging is deteriorated, the cleaning can be performed to solve the ejection failure of the nozzles 12 before printing. Therefore, according to the fourth maintenance process, it is possible to suppress deterioration of the printing quality.

Next, a fifth maintenance process, which is an example of the maintenance process, will be described. The fifth maintenance process is performed, for example, before starting printing on the medium 99. In this case, the fifth maintenance process is performed when print data is input. The fifth maintenance process is a maintenance process in which the process of step S17 is omitted, as compared with the first maintenance process. Therefore, the fifth maintenance process will be mainly described for points different from those for the first maintenance process.

Figure 7:
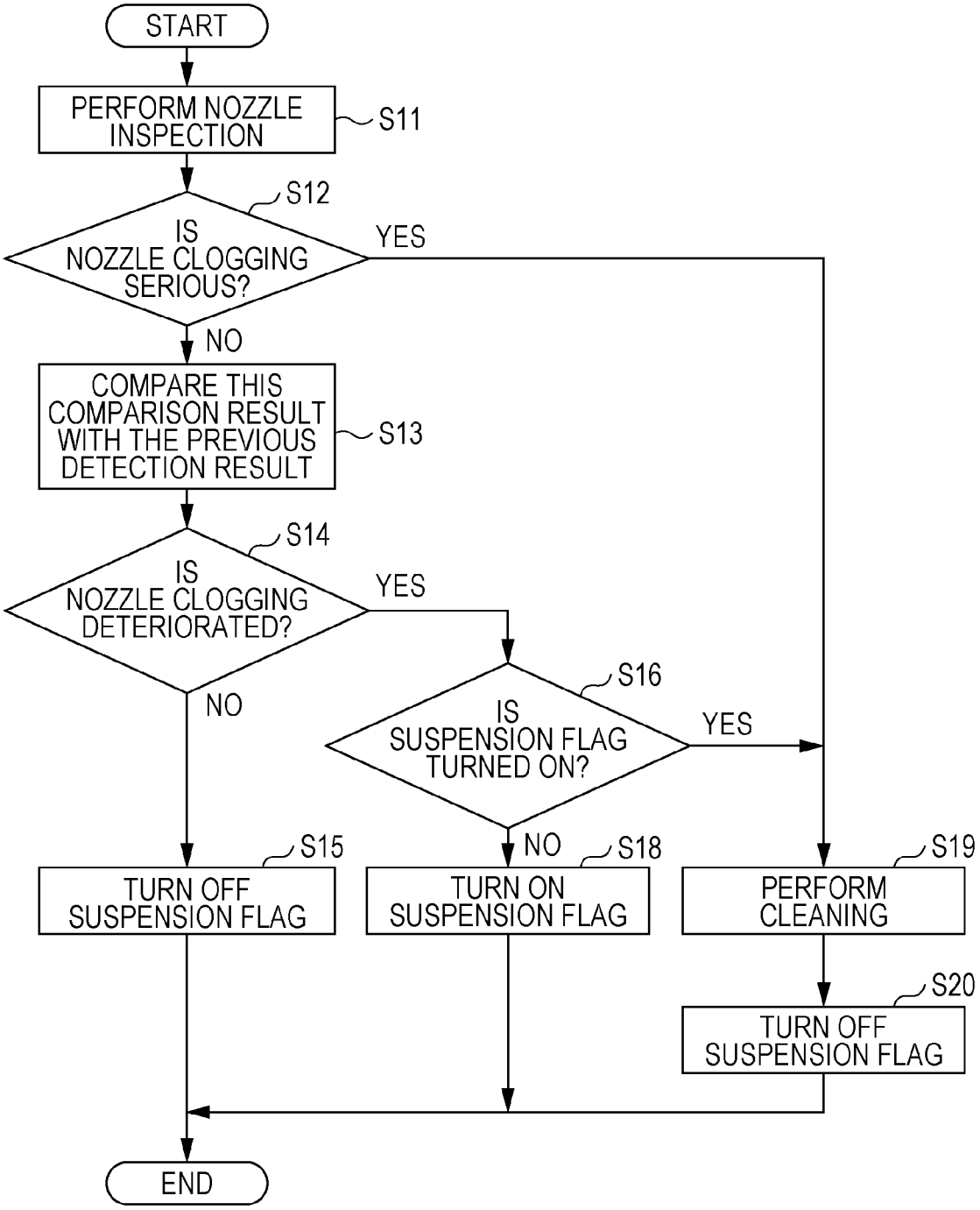
FIG. 7 is a flowchart of a fifth maintenance process.

As shown in FIG. 7, when the suspension flag is turned off in step S16, the controller 41 that performs the fifth maintenance process shifts the process to step S18. Unlike the first maintenance process, the fifth maintenance process is performed before printing. Therefore, even when the moisturizing capping is performed, it is difficult to secure time to solve the ejection failure of the nozzles 12 as in the fourth maintenance process. Unlike the fourth maintenance process, in the fifth maintenance process, the cleaning is not performed when the suspension flag is turned off even when the nozzle clogging is deteriorating. That is, the cleaning is suspended. As a result, it is possible to suppress the consumption of the liquid.

The controller 41 may have at least one maintenance process among the first maintenance process, the second maintenance process, and the third maintenance process. The controller 41 may further include at least one of the fourth maintenance process and the fifth maintenance process.

When performing the second maintenance process after printing, in the fourth maintenance process performed before printing, the process of step S15 may be omitted, and the process of step S20 may be replaced with the process of step S34. In this case, the processing content of the fourth maintenance processing can be made to correspond to the processing content of the second maintenance processing.

When performing the second maintenance process after printing, in the fifth maintenance process performed before printing, the process of step S15 may be omitted, the process of step S18 may be replaced with the process of step S33, and the process of step S20 may be replaced with the process of step S34. In this case, the processing content of the fifth maintenance processing can be made to correspond to the processing content of the second maintenance processing.

Next, the functions and effects of the above embodiment will be described.

(1) When the number of the nozzles 12 nozzles whose ejection failure is detected is equal to or less than a predetermined number, the ejection failure of the nozzles 12 may be solved without discharging the liquid from the nozzles 12 by covering the nozzles 12 with the cap 27. When the number of the nozzles 12 nozzles whose ejection failure is detected is greater than the predetermined number, the ejection failure of the nozzles 12 is solved by discharging the liquid from the nozzles 12. As a result, it is possible to reduce the frequency of discharging the liquid from the nozzles 12 in order to solve the ejection failure of the nozzles 12. Therefore, the consumption of the liquid can be reduced.

(2) When the number of the nozzles 12 nozzles whose ejection failure is detected is equal to or less than a predetermined number, the liquid is ejected from the nozzles 12 into the cap 27 and the nozzles 12 are covered with the cap 27. When the nozzles 12 are covered by the cap 27 into which the liquid is ejected, the nozzles 12 are further moisturized. As a result, the possibility of solving the ejection failure of the nozzles 12 can be improved.

(3) When the number of the nozzles 12 nozzles whose ejection failure is detected is equal to or less than a predetermined number and continuously increases, the liquid is discharged from the nozzles 12. In a case where the number of the nozzles 12 nozzles whose ejection failure is detected is on the rise even when the number is equal to or less than a predetermined number, it can be assumed that the ejection failure is not solved just by covering the nozzles 12 with the cap 27. Therefore, when the number of the nozzles 12 nozzles whose ejection failure is detected increases continuously, the liquid is discharged from the nozzles 12. As a result, the ejection failure of the nozzles 12 can be solved.

(4) After the print is completed, the ejection state of the nozzles 12 is inspected. In this case, after the print is completed, an appropriate operation can be performed in order to solve the ejection failure of the nozzles 12.

(5) Before the print is started, the ejection state of the nozzles 12 is inspected. In this case, by inspecting the ejection state of the nozzles 12 before the print is started, it is possible to reduce the possibility of performing printing by the nozzles 12 in which the ejection failure has occurred. As a result, it is possible to suppress deterioration of the printing quality.

The present embodiment can be modified as follows. The present embodiment and the following modifications can be implemented in combination with one another as long as there is no technical contradiction.

The liquid ejecting apparatus 11 may include a moisturizing cap in addition to the cap 27. In this case, the cap 27 is used to perform suction cleaning. The moisturizing cap is used to moisturize the nozzles 12. The moisturizing cap may be capable of storing an externally supplied moisturizing fluid therein. In this case, when the moisturizing capping is performed, the nozzles 12 can be further moisturized without ejecting the liquid from the nozzles 12 into the moisturizing cap.

The first maintenance process, the second maintenance process, and the third maintenance process may be performed before the print is started.

The same maintenance process may be performed before the print is started and after the print is completed.

The medium 99 is not limited to paper, but may be a plastic film, a metal film, a fabric cloth, or the like. The liquid ejected by the liquid ejecting head 13 is not limited to ink, and may be, for example, a liquid in which particles of a functional material are dispersed or mixed in the liquid. For example, the liquid ejecting head 13 may eject a liquid containing, in the form of dispersion or dissolution, a material such as an electrode material or a pixel material used in the manufacture of a liquid crystal display, an electroluminescence display, a surface emission display, and the like.

In the following, technical ideas and their functions and effects which are grasped from the above-described embodiments and modifications will be described. The method of controlling a liquid ejecting apparatus includes detecting, by inspecting an ejection state of nozzles from which the liquid is ejected, an ejection failure of the nozzles, covering the nozzles with a cap when the number of the nozzles whose ejection failure is detected is equal to or less than a predetermined number, and discharging the liquid from the nozzles when the number of the nozzles whose ejection failure is detected is greater than the predetermined number.

Covering the nozzles with a cap moistens the nozzles. When the ejection failure of the nozzles is minor, the ejection failure of the nozzles may be solved by moisturizing the nozzles. For this reason, when the number of the nozzles whose ejection failure is detected is equal to or less than a predetermined number, the ejection failure of the nozzles may be solved without discharging the liquid from the nozzles by covering the nozzles with the cap. When the number of the nozzles whose ejection failure is detected is greater than a predetermined number, the ejection failure of the nozzles is solved by discharging the liquid from the nozzles. According to this method, it is possible to reduce the frequency of discharging the liquid from the nozzles in order to solve the ejection failure of the nozzles. Therefore, the consumption of the liquid can be reduced.

In the method of controlling the liquid ejecting apparatus, the nozzles may be covered by the cap after ejecting the liquid from the nozzles into the cap when the number of the nozzles whose ejection failure is detected is equal to or less than the predetermined number.

According to this method, when the nozzles are covered by the cap into which the liquid is ejected, the nozzles are further moisturized. This can improve the possibility of solving the ejection failure of the nozzles. In the method of controlling the liquid ejecting apparatus, the inspection of the ejection state of the nozzles may be repeated, and the liquid may be discharged from the nozzles when the number of the nozzles whose ejection failure is detected is equal to or less than a predetermined number and continuously increases.

In a case where the number of the nozzles whose ejection failure is detected is on the rise even when the number is equal to or less than a predetermined number, it can be assumed that the ejection failure is not solved just by covering the nozzles with the cap. Therefore, when the number of the nozzles whose ejection failure is detected increases continuously, the liquid is discharged from the nozzles. According to the above method, the ejection failure of the nozzles can be solved.

In the method of controlling the liquid ejecting apparatus, the ejection state of the nozzles may be inspected after printing onto the medium by ejecting the liquid from the nozzles is completed. According to this method, after the print is completed, an appropriate operation can be performed in order to solve the ejection failure of the nozzles.

In the method of controlling the liquid ejecting apparatus, the ejection state of the nozzles may be inspected before the print is started. According to this method, by inspecting the ejection state of the nozzles before the print is started, it is possible to reduce the possibility of performing printing by the nozzles in which the ejection failure has occurred. As a result, it is possible to suppress deterioration of the printing quality.

The liquid ejecting apparatus includes a liquid ejecting head that ejects liquid from a plurality of nozzles, a cap configured to cover the nozzles, a detecting portion that detects an ejection failure of the nozzles by inspecting an ejection state of the nozzles, a maintenance unit that discharges the liquid from the nozzles, and a controller. The controller covers the nozzles with the cap when the number of the nozzles whose ejection failure is detected by the detecting portion is equal to or less than a predetermined number, and discharges the liquid from the nozzles by the maintenance unit when the number of the nozzles whose ejection failure is detected by the detecting portion is greater than the predetermined number.

Covering the nozzles with a cap moistens the nozzles. Moisturizing the nozzles may solve the ejection failure of the nozzles. For this reason, when the number of the nozzles whose ejection failure is detected is equal to or less than a predetermined number, the ejection failure of the nozzles can be solved without discharging the liquid from the nozzles by covering the nozzles with the cap. When the number of the nozzles whose ejection failure is detected is greater than a predetermined number, the ejection failure of the nozzles is solved by discharging the liquid from the nozzles. According to this configuration, it is possible to reduce the frequency of discharging the liquid from the nozzles in order to solve the ejection failure of the nozzles. Therefore, the consumption of the liquid can be reduced.

In the liquid ejecting apparatus, the controller may eject the liquid from the nozzles into the cap, and cover the nozzles with the cap when the number of the nozzles whose ejection failure is detected by the detecting portion is equal to or less than the predetermined number.

According to this configuration, when the nozzles are covered by the cap into which the liquid is ejected, the nozzles are further moisturized. This can improve the possibility of solving the ejection failure of the nozzles. In the liquid ejecting apparatus, the controller may repeat the inspection of the ejection state of the nozzles, and discharge the liquid from the nozzles by the maintenance unit when the number of the nozzles whose ejection failure is detected by the detecting portion is equal to or less than a predetermined number and continuously increases.

In a case where the number of the nozzles whose ejection failure is detected is on the rise even when the number is equal to or less than a predetermined number, it can be assumed that the ejection failure is not solved just by covering the nozzles with the cap. Therefore, when the number of the nozzles whose ejection failure is detected increases continuously, the liquid is discharged from the nozzles. According to the above configuration, the ejection failure of the nozzles can be solved.

What is claimed is:

1. A method of controlling a liquid ejecting apparatus, the method comprising:

detecting, by inspecting an ejection state of nozzles from which liquid is ejected, an ejection failure of the nozzles;

covering the nozzles with a cap when the number of the nozzles whose ejection failure is detected is equal to or less than a predetermined number, the predetermined number being a value of one or more;

discharging the liquid from the nozzles when the number of the nozzles whose ejection failure is detected is greater than the predetermined number; and performing a complementary printing which ejects the liquid from normal nozzles adjacent to a failed nozzle when election failure is detected by the detecting portion.

2. The method of controlling the liquid ejecting apparatus according to claim 1, wherein the covering includes ejecting the liquid from the nozzles into the cap before the cap covers the nozzles when the number of the nozzles whose ejection failure is detected is equal to or less than the predetermined number.

3. The method of controlling the liquid ejecting apparatus according to claim 1, wherein the discharging includes repeating the inspection of the ejection state of the nozzles, and discharging the liquid from the nozzles when the number of the nozzles whose ejection failure is detected is equal to or less than the predetermined number and whose ejection failure continuously increases.

4. The method of controlling the liquid ejecting apparatus according to claim 1, wherein the ejection state of the nozzles is inspected after printing onto a medium by ejecting the liquid from the nozzles is completed.

5. The method of controlling the liquid ejecting apparatus according to claim 4, wherein the covering includes covering the nozzles by the cap until the printing to be performed next is started when the number of the nozzles whose ejection failure is detected is equal to or less than the predetermined number.

6. The method of controlling the liquid ejecting apparatus according to claim 4, wherein the ejection state of the nozzles is inspected before the printing is started.

7. A liquid ejecting apparatus comprising:

a liquid ejecting head that ejects liquid from a plurality of nozzles;

a cap configured to cover the nozzles;

a detecting portion that detects an ejection failure of the nozzles by inspecting an ejection state of the nozzles;

a maintenance unit that discharges the liquid from the nozzles; and a controller, wherein the controller covers the nozzles with the cap when the number of the nozzles whose ejection failure is detected by the detecting portion is equal to or less than a predetermined number, and discharges the liquid from the nozzles by the maintenance unit when the number of the nozzles whose ejection failure is detected by the detecting portion is greater than the predetermined number, the predetermined number being a value of one or more, and performs a complementary printing which elects the liquid from normal nozzles adjacent to a failed nozzle when ejection failure is detected by the detecting portion.

8. The liquid ejecting apparatus according to claim 7, wherein the controller ejects the liquid from the nozzles into the cap, and covers the nozzles with the cap when the number of the nozzles whose ejection failure is detected by the detecting portion is equal to or less than the predetermined number.

9. The liquid ejecting apparatus according to claim 7, wherein the controller repeats the inspection of the ejection state of the nozzles, and discharges the liquid from the nozzles by the maintenance unit when the number of the nozzles whose ejection failure is detected by the detecting portion is equal to or less than the predetermined number and whose ejection failure continuously increases.

10. The method of controlling the liquid ejecting apparatus according to claim 1, wherein when ejection failure is deteriorating, performing the complementary printing.

11. The method of controlling the liquid ejecting apparatus according to claim 7, wherein when ejection failure is deteriorating, performing the complementary printing.

* * * * *